US009033678B2

(12) United States Patent
Tsai

(10) Patent No.: US 9,033,678 B2
(45) Date of Patent: May 19, 2015

(54) AIR PUMP HAVING AN AUTO-STOP CONTROL DEVICE

(75) Inventor: Chun-Chung Tsai, New Taipei (TW)

(73) Assignee: DONGGUAN TIGER POINT METAL & PLASTIC PRODUCTS CO., LTD., Guang Dong Province (CN)

( * ) Notice: Subject to any disclaimer, the term of this patent is extended or adjusted under 35 U.S.C. 154(b) by 307 days.

(21) Appl. No.: 13/409,378

(22) Filed: Mar. 1, 2012

(65) Prior Publication Data

US 2013/0230410 A1 Sep. 5, 2013

(51) Int. Cl.

| | |
|---|---|
| ***F04D 27/00*** | (2006.01) |
| ***F04D 15/00*** | (2006.01) |
| ***A47C 27/08*** | (2006.01) |
| ***F04D 25/08*** | (2006.01) |
| *F04D 15/02* | (2006.01) |

(52) U.S. Cl.

CPC ..... *F04D 27/008* (2013.01); *F04D 15/0016* (2013.01); *F04D 15/02* (2013.01); *A47C 27/083* (2013.01); *F04D 25/084* (2013.01)

(58) Field of Classification Search

CPC ..... F04D 15/0005; F04D 15/0016; F04D 15/0022; F04D 17/10; F04D 13/16; F04D 27/005; F04D 29/40; F04D 15/02; F04B 35/06; F04B 41/02; F04B 49/02; F04B 49/03; F04B 49/225; A47C 27/081; A47C 27/083

USPC ..... 417/234, 239, 315, 423.14

See application file for complete search history.

(56) References Cited

U.S. PATENT DOCUMENTS

| | | | | |
|---|---|---|---|---|
| 7,475,443 | B2 * | 1/2009 | Wang | 5/713 |
| 2008/0201857 | A1 * | 8/2008 | Kelly | 5/713 |
| 2008/0286117 | A1 * | 11/2008 | Kehrmann et al. | 417/1 |
| 2010/0247337 | A1 * | 9/2010 | Tsai | 417/239 |

* cited by examiner

*Primary Examiner* — Bryan Lettman
*Assistant Examiner* — Charles W Nichols
(74) *Attorney, Agent, or Firm* — Lin & Associates IP, Inc.

(57) ABSTRACT

An air pump includes a casing, a blower connected with a motor, an air flow direction switching device, an air valve, and an auto-stop control device. The air flow direction switching device includes a pressure sensor and a pressure switch. The air flow direction switching device includes a movable box and a driving device which drives the movable box. The movable box has an arm and an activation portion. An inflation switch and a deflation switch are electrically connected in parallel to a circuit and are controlled to activate by the activation portion. The pressure switch includes a dynamic contact point connected to the motor, and two static contact points respectively electrically connected to the inflation switch and the deflation switch. The dynamic contact point has a terminal which alternatively contacts the two static contact points.

6 Claims, 9 Drawing Sheets

AIR PUMP HAVING AN AUTO-STOP CONTROL DEVICE

BACKGROUND OF THE INVENTION

1. Field of the Invention

The present invention generally relates to an inflation device, and in particular to an air pump having an auto-stop control device.

2. The Prior Arts

Air pumps are a key element to inflatable products such as inflatable beds, sofa and large toys. The air pumps are disposed in such products so as to quickly inflate the inflatable products and maintain the pressure inside the inflatable products. These inflatable products can be deflated to reduce the occupied space for convenience of storage. Even though the conventional air pumps can automatically stop once these inflatable products reach a desired pressure, there exist shortcomings in operation. For example, the air flow direction can not be switched, so that such inflatable products can not be changed in the operation mode between inflation and deflation. That needs the users to manually switch the operation mode. Besides, the required deflation time is too long, which does not meet the requirements in the market. As such, it is desired to have an improved air pump.

SUMMARY OF THE INVENTION

A primary objective of the present invention is to provide an air pump which improves the inherent shortcomings of the conventional air pumps.

In order to achieve the above mentioned objective, an air pump according to the present invention comprises a casing, a blower connected with a motor, an air flow direction switching device, an air valve, and an auto-stop control device. The auto-stop control device has a deformable pressure sensor and a pressure switch located beside the pressure sensor. The air flow direction switching device has a movable box and a driving device which drives the movable box. The movable box has an arm which is used to open the air valve. The movable box has an activation portion on the arm. An inflation switch and a deflation switch are electrically connected in parallel to a circuit and are controlled to activate by the activation portion. The pressure switch has a dynamic contact point and two static contact points, wherein the dynamic contact point is electrically connected to the motor and the two static contact points are respectively connected to the inflation switch and the deflation switch. The dynamic contact point has a terminal which alternatively contacts the two static contact points.

Preferably, the activation portion includes an inflation switch activation member and a deflation switch activation member. The inflation switch activation member and the deflation switch activation member are respectively disposed at the arm.

Preferably, the inflation switch activation member and the deflation switch activation member are arranged in a staggered manner with each other. The deflation switch activation member is located at a rear end of the inflation switch activation member, and the inflation switch is located above the deflation switch which is located behind the inflation switch.

Preferably, the inflation switch activation member has a curved block located at a front end thereof so as to activate the inflation switch.

Preferably, the deflation switch activation member is a curved block located on the arm. The arm extends with a guide block along a direction which the deflation switch activation member moves along.

Preferably, the driving device includes a knob on a top of the casing, a gear located at an underside of the knob and connected thereto, and a rack connected to one side of the movable box and engaged with the gear. The knob drives the gear to move the movable box linearly.

Preferably, the inflation switch and the deflation switch are respectively disposed on the casing.

Preferably, the casing has a space defined in a side thereof, and the auto-stop control device and cables are accommodated within the space. A cover is connected to the casing so as to open or close the space.

Preferably, a manual switch is electrically connected between the motor and a power source in series so as to control the operation of the air pump.

The air pump of the present invention provides a pressure switch which is alternatively connected between the inflation switch and the deflation switch, and the activation portion controls the operation of the inflation switch and the deflation switch so as to be able to switch the operation mode between inflation and deflation, and automatically stop. Therefore, the air pump of the present invention has the advantages of structure simple, operation convenient, performance excellent, and labor and time saving, thereby increasing the competition of the products on the market.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
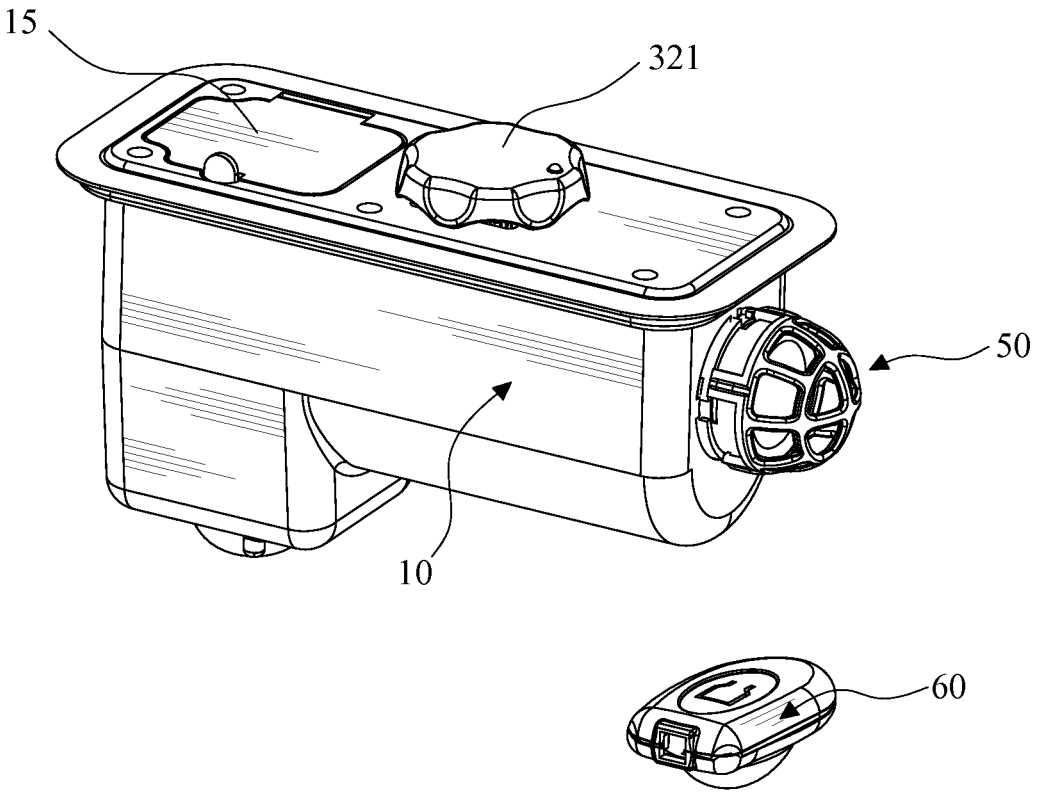
FIG. 1 is a perspective view showing an air pump in accordance with the present invention.

With reference to the drawings and in particular to FIGS. 1 to 9, an air pump in accordance with the present invention comprises a casing 10, a blower 20, an air flow direction switching device 30, an auto-stop control device 40, and an air valve 50.

Figure 2:
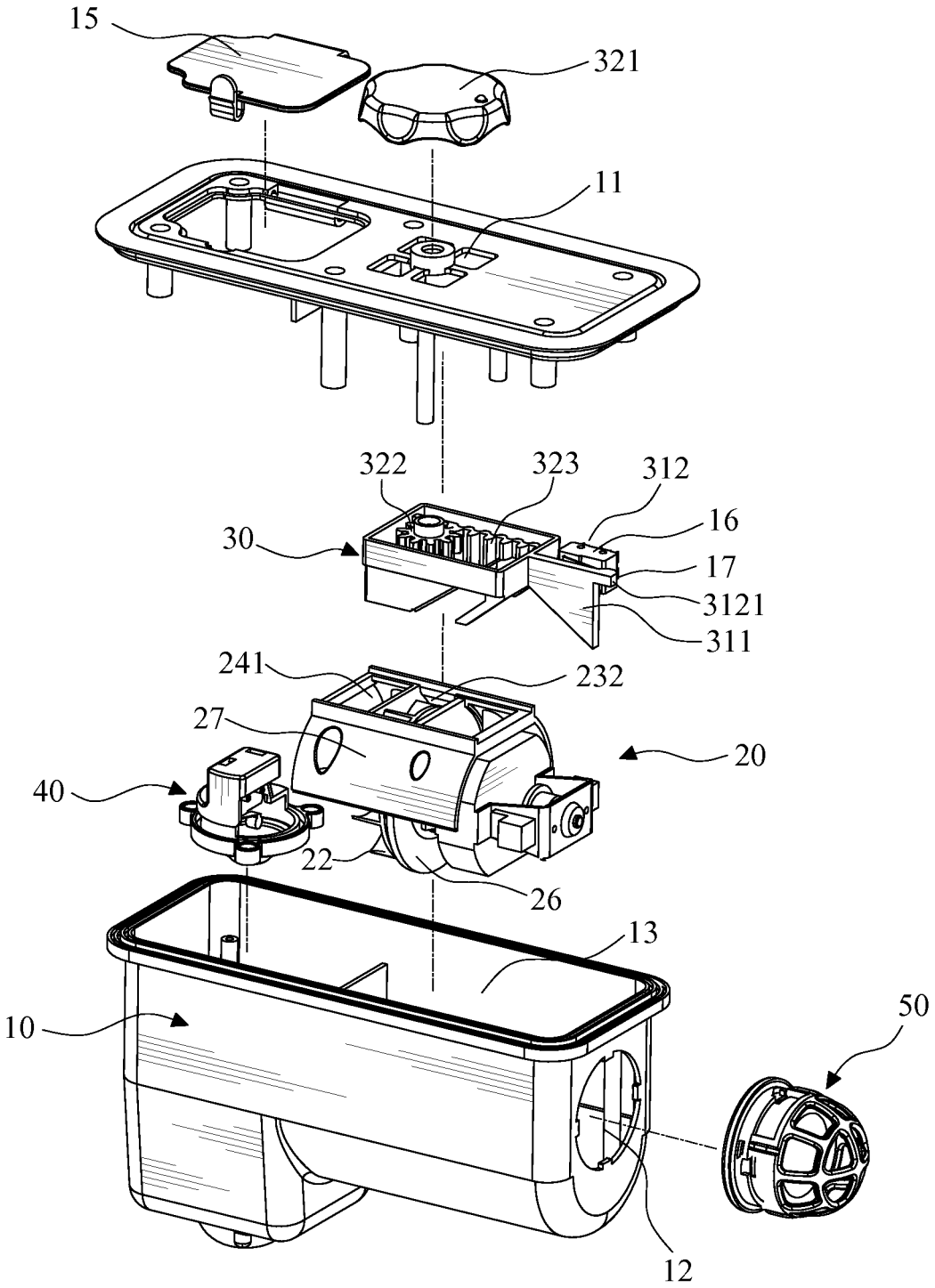
FIG. 2 is an exploded perspective view of the air pump of the present invention.
Figure 8:
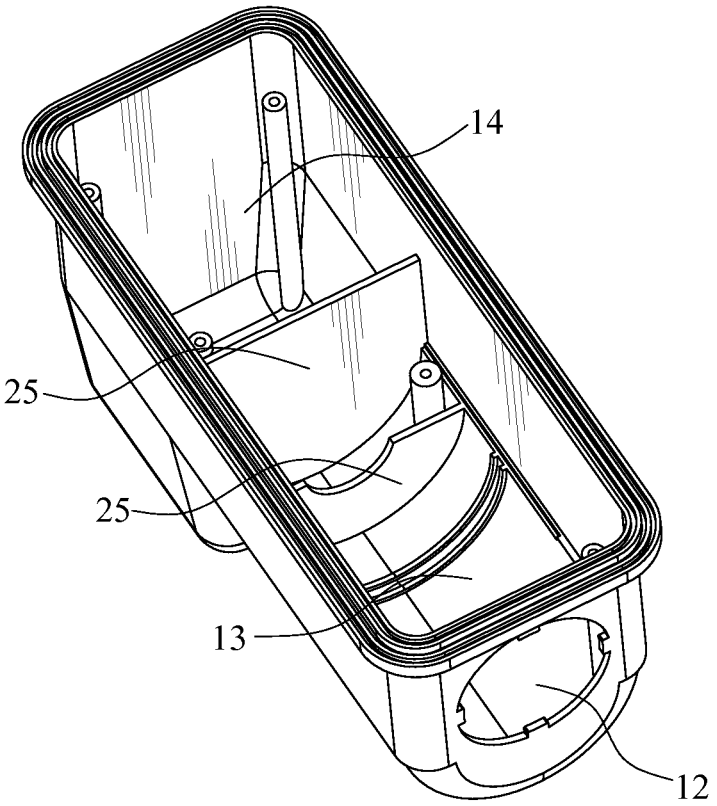
FIG. 8 shows an internal structure of a housing according to the present invention.

As shown in FIGS. 1, 2 and 8, the casing 10 has a space 13 which is equipped with an inflation switch 16 and a deflation switch 17 for controlling the air pump to inflate or deflate the products. The casing 10 has a first air hole 11 and a second air hole 12, wherein the first air hole 11 communicates with the space 13 and is exposed from an inflatable product. The second air hole 12 communicates between the space 13 and the inflatable product. Two boards 25 are disposed in the space 13 to define another space 14 for accommodating the auto-stop control device 40 and cables. A cover 15 is connected to the casing 10 so as to open or close the space 14.

As shown in FIGS. 2, 4, 5 and 6, the blower 20 is disposed in the space 13 and includes a motor 21, a blade wheel 22, a first chamber 23 and a second chamber 24. The blade wheel 22 is connected to a shaft of the motor 21. The first and second chambers 23, 24 are defined by the two boards 25, a curved board 27, and a rear cover 26 disposed in the space 13. The first and second chambers 23, 24 are located in parallel along an axis of the blade wheel 22. The first chamber 23 communicates with the second chamber 24 via a first hole 231. A first vent 232 and a second vent 241 are respectively located on a same side of the first and second chambers 23, 24. The first vent 232 and the second vent 241 are located parallel along a normal direction of the blade wheel 22.

Figure 3:
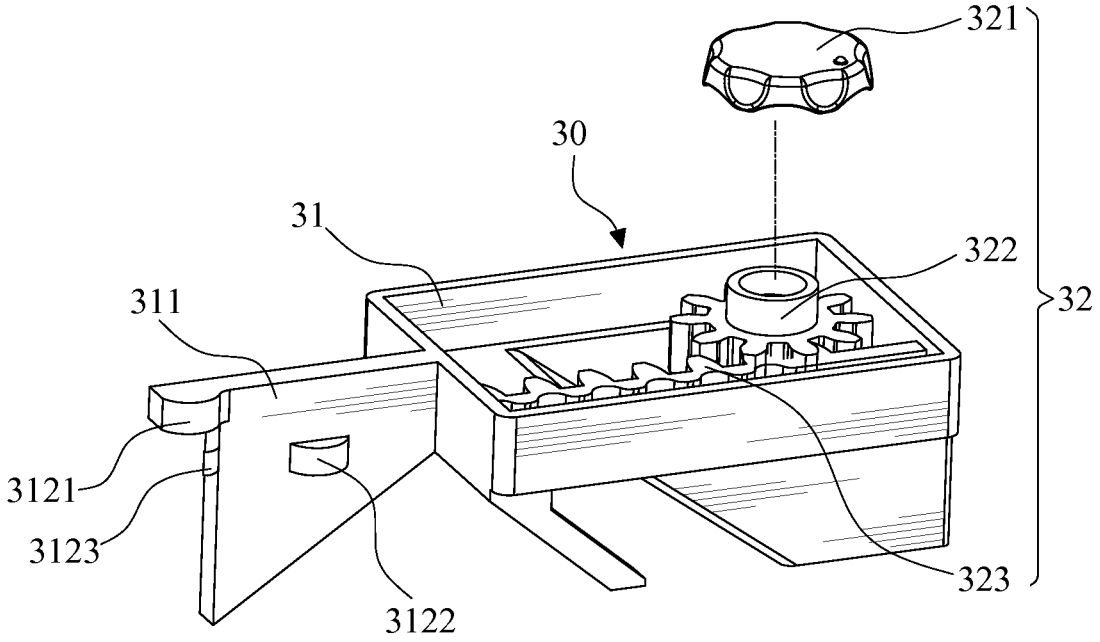
FIG. 3 is a perspective view showing an air flow direction switching device according to the present invention.
Figure 4:
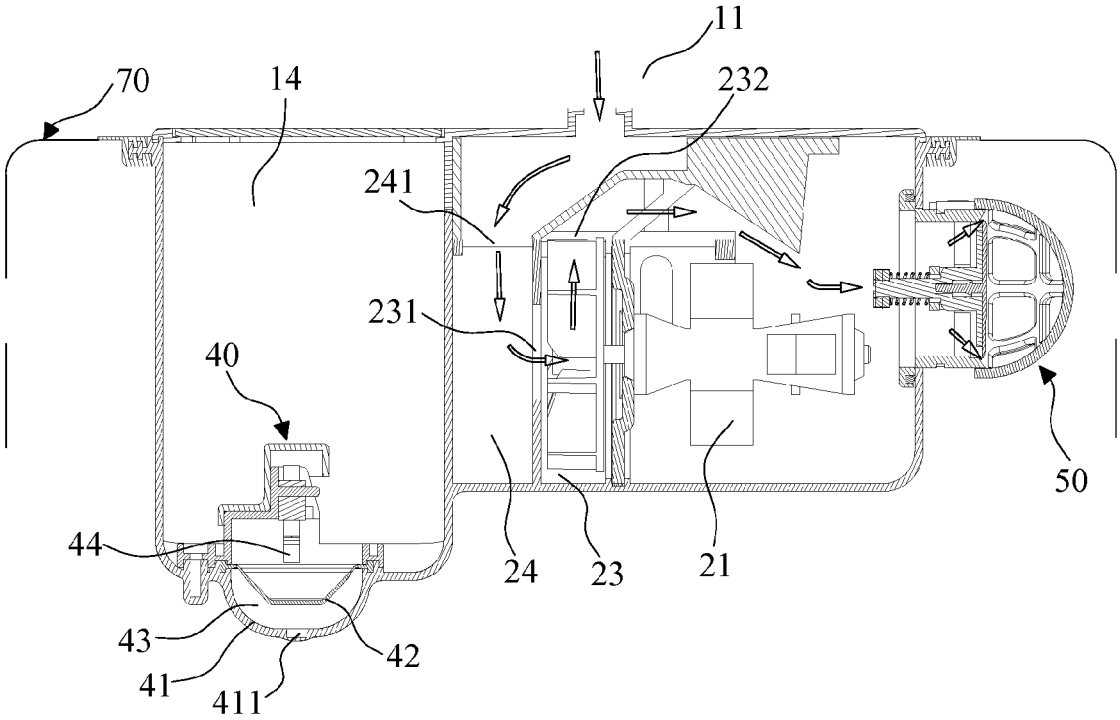
FIG. 4 shows that the air pump of the present invention is in an inflation mode.
Figure 5:
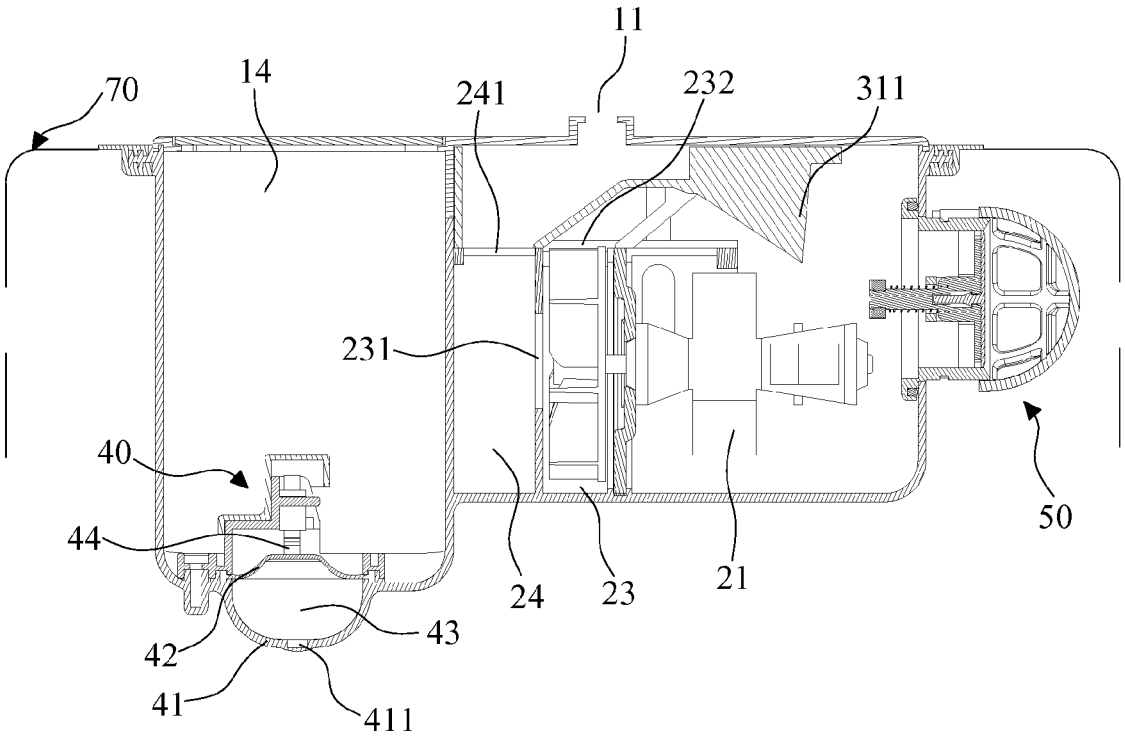
FIG. 5 shows that the air pump of the present invention is in a pressure maintaining mode.
Figure 6:
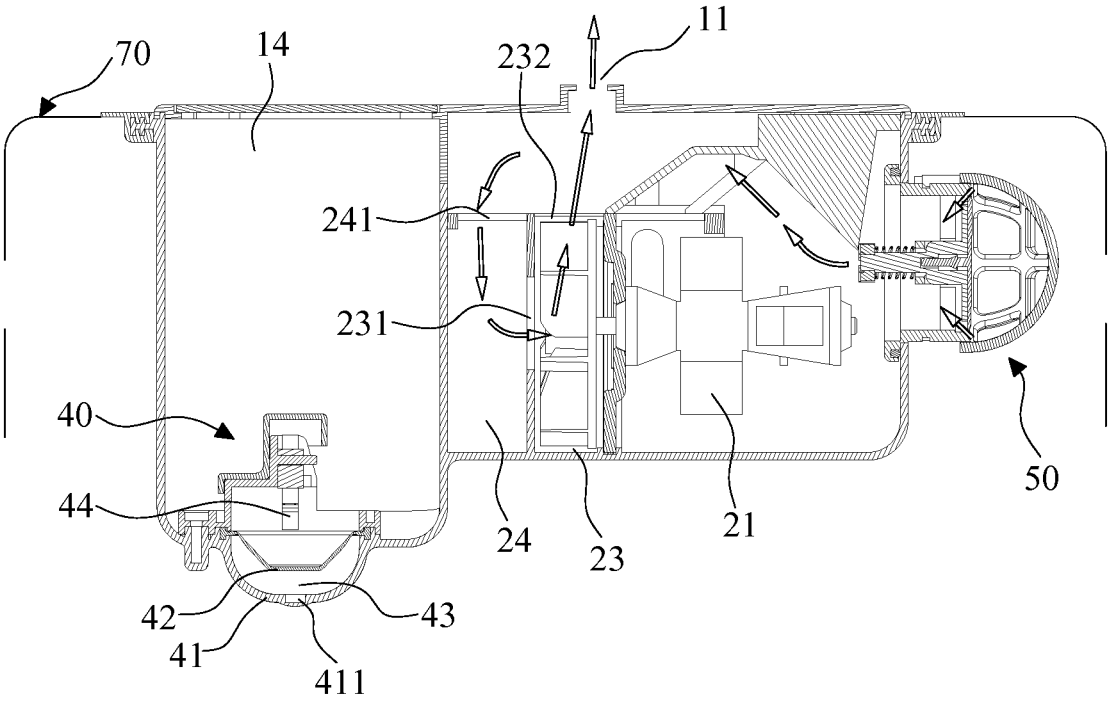
FIG. 6 is shows that the air pump of the present invention is in a deflation mode.
Figure 7:
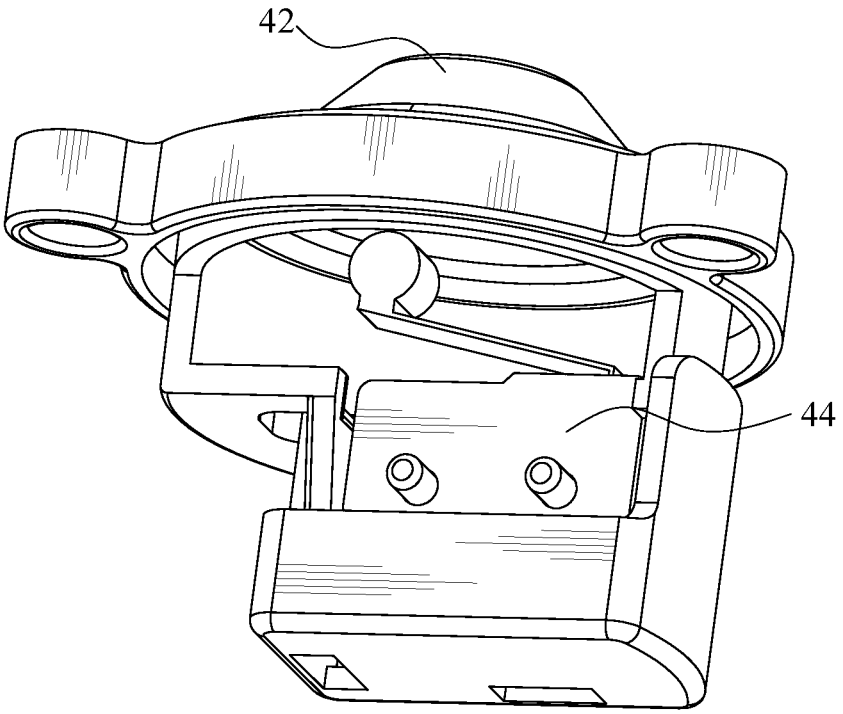
FIG. 7 is a perspective schematic view showing a partial auto-stop control device according to the present invention.

As shown in FIG. 3, the air flow direction switching device 30 is located in the space 13 of the casing 10. The air flow direction switching device 30 has a movable box 31 and a driving device 32. The first and second vents 232, 241 alternatively communicate with the second air hole 12 by shifting the movable box 31. The driving device 32 is used to drive the movable box 31 along the normal direction of the blade wheel 22.

As shown in FIG. 3, the driving device 32 includes a knob 321 on a top of the casing 10, a gear 322 located at an underside of the knob 321 and connected thereto, and a rack 323 connected to one side of the movable box 31 and engaged with the gear 322. The knob 321 drives the gear 322 to move the movable box 31 linearly. The movable box 31 has an arm 311 extended from a front wall thereof so as to open the air valve 50. The arm 311 has an activation portion 312 to control the inflation switch 16 and the deflation switch 17 to be opened or closed. The activation portion 312 includes an inflation switch activation member 3121 and a deflation switch activation member 3122. The inflation switch activation member 3121 and the deflation switch activation member 3122 are respectively connected to the arm 311. The inflation switch activation member 3121 and the deflation switch activation member 3122 are arranged in a staggered manner with each other in a vertical direction. The deflation switch activation member 3122 is located at a rear end of the inflation switch activation member 3121. In corresponding thereto, the inflation switch 16 is located above the deflation switch 17 which is located behind the inflation switch 16. The inflation switch activation member 3121 has a curved block located at a front end thereof so as to activate the inflation switch 16. The deflation switch activation member 3122 is a curved block located on the arm 311. The arm 311 extends with a guide block 3123 along a direction which the deflation switch activation member 3122 moves along. The inflation switch activation member 3121 and the deflation switch activation member 3122 are respectively in contact with or separated from the inflation switch 16 and the deflation switch 17 along with the movement of the arm 311.

The auto-stop control device 40 is disposed within the space 14 as shown in FIGS. 4-8 so as to detect the pressure of an inflatable product 70. In this embodiment, the auto-stop control device 40 is used to cut off the power of the motor 21 and then stop the air pumped into the inflatable product 70. The auto-stop control device 40 has a hollow body 41 with an open top, and a deformable pressure sensor 42 engaged with the open top. The deformable pressure sensor 42 and the hollow body 41 together define a first room 43. A hole 411 is defined through an underside of the hollow body 41 and communicates between the first room 43 and the inflatable product 70. A pressure switch 44 is located beside the pressure sensor 42 and electrically connected in series with the power source and the motor 21.

The air valve 50 is disposed at the second air hole 12 for controlling the air flow there through.

Figure 9:
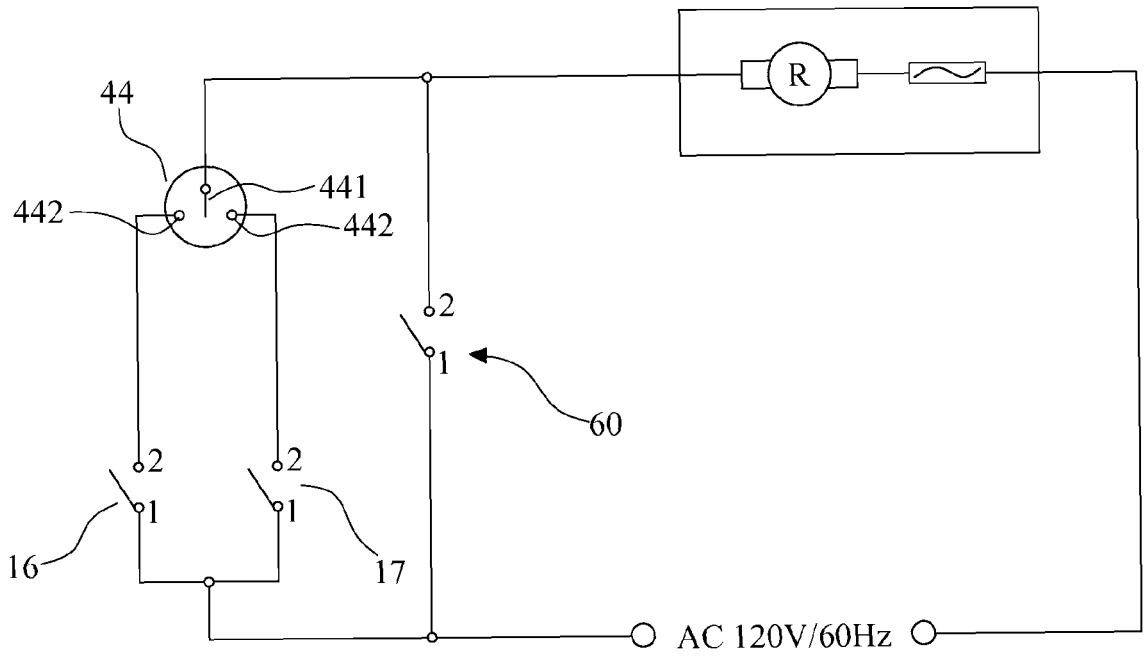
FIG. 9 shows a schematic circuit diagram according to the present invention.

FIG. 9 shows a schematic circuit diagram according to the present invention. The motor 21 is electrically connected in series with the pressure switch 44. The inflation switch 16 and the deflation switch 17 are electrically connected in parallel to the circuit. The pressure switch 44 has a dynamic contact point 441 and two static contact points 442. The dynamic contact point 441 is electrically connected to the motor 21 and the two static contact points 442 are respectively in contact with the inflation switch 16 and the deflation switch 17. The dynamic contact point 441 has a terminal which alternatively contacts the two static contact points 442.

Furthermore, a manual switch 60 is electrically connected in series between the motor 21 and the power source so as to remote control the motor 21 to inflate or deflate the inflatable product 70.

When inflating the inflatable product 70, the terminal on the pressure switch 44 is in contact with the static contact point 442 connected to the inflation switch 16. By moving the arm 311, the inflation switch activation member 3121 activates the inflation switch 16, so that the motor 21 is electrically powered by the power source.

When the inflation of the inflatable product 70 is completed, the terminal on the pressure switch 44 is separated from the static contact point 442 connected to the inflation switch 16, and is electrically connected with the static contact point 442 connected to the deflation switch 17. In the meanwhile, the deflation switch activation member 3122 does not activate the deflation switch 17. That means the deflation switch 17 is in "OFF" state. The motor 21 is not electrically connected to the power source, so that the inflatable product 70 maintains its pressure.

When deflating the inflatable product 70, the terminal on the pressure switch 44 is electrically connected to the static contact point 442 connected to the deflation switch 17. By moving the arm 311, the deflation switch activation member 3122 activates the deflation switch 17, so that the motor 21 is electrically powered by the power source, and the air is deflated from the inflatable product 70 until a desired pressure level is reached. The terminal on the pressure switch 44 is electrically cut off from the static contact point 442 connected to the deflation switch 17, and is electrically connected to the static contact point 442 connected to the inflation switch 16.

The pressure switch 44 is alternatively connected to the deflation switch 17 and the inflation switch 16, and by using the activation portion 312 to control the operation of the deflation switch 17 and the inflation switch 16, the air pump of the present invention can change the mode of operation between inflation and deflation, and automatically stop. Therefore, the air pump of the present invention has the advantages of structure simple, operation convenient, performance excellent, and labor and time saving, thereby increasing the competition of the products on the market.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An air pump comprising:

a casing;

a blower connected with a motor;

an air valve;

an auto-stop control device having a deformable pressure sensor and a pressure switch located beside the pressure sensor; and an air flow direction switching device having a movable box formed by a plurality of side walls with an opening at a top end and a bottom end thereof and a driving device which drives the movable box, the driving device including a knob on a top of the casing with the movable box pierced by the axis of the knob, a gear located at an underside of the knob and connected thereto, and a rack connected to an inner surface of one of the side walls and engaged with the gear, the knob driving the gear to move the movable box linearly between a first position and a second position, and the movable box having an arm disposed at an external surface of one of the side walls for controlling the air valve to be open or closed, wherein the movable box has an activation portion, an inflation switch and a deflation switch are electrically connected in parallel to a circuit and are controlled to activate by the activation portion, the pressure switch includes a dynamic contact point and two static contact points, the dynamic contact point is electrically connected to the motor and the two static contact points respectively are electrically connected to the inflation switch and the deflation switch, and the dynamic contact point has a terminal which alternatively contacts the two static contact points, wherein the activation portion includes an inflation switch activation member and a deflation switch activation member respectively disposed at the arm and arranged in a staggered manner with each other, the deflation switch activation member is located at a rear end of the inflation switch activation member, and the inflation switch is located above the deflation switch which is located behind the inflation switch, wherein when the movable box is in the first position and the terminal of the dynamic contact point is in contact with the static contact point connected to the inflation switch, the inflation switch activation member activates the inflation switch so that the motor is electrically powered by a power source, wherein when the movable box moves between the first and second positions, the inflation switch activation member does not activate the inflation switch and the deflation switch activation member does not activate the deflation switch so that the motor is not electrically powered by the power source, and wherein when the movable box is in the second position and the terminal of the dynamic contact point is in contact with the static contact point connected to the deflation switch, the deflation switch activation member activates the deflation switch so that the motor is electrically powered by the power source.

2. The air pump as claimed in claim 1, wherein the inflation switch activation member has a curved block located at a front end thereof so as to activate the inflation switch.

3. The air pump as claimed in claim 1, wherein the deflation switch activation member is a curved block located on the arm, and the arm extends with a guide block along a direction which the deflation switch activation member moves along.

4. The air pump as claimed in claim 1, wherein the inflation switch and the deflation switch are disposed on the casing.

5. The air pump as claimed in claim 1, wherein the casing has a space defined in a side thereof, the auto-stop control device and cables are accommodated within the space, and a cover is connected to the casing so as to open or close the space.

6. The air pump as claimed in claim 1, wherein a manual switch is electrically connected between the motor and a power source in series so as to control the operation of the air pump.

* * * * *